US006085616A

United States Patent [19]

Habermehl

[11] Patent Number: 6,085,616

[45] Date of Patent: Jul. 11, 2000

[54] SCREWDRIVER FOR JOINING METAL FRAMING

[76] Inventor: G. Lyle Habermehl, 436 Calvert Dr., Gallatin, Tenn. 37066

[21] Appl. No.: 09/140,508

[22] Filed: Aug. 26, 1998

[51] Int. Cl.[7] ..... B25B 23/06

[52] U.S. Cl. ..... 81/55; 81/434; 81/435

[58] Field of Search ..... 81/55, 434, 435, 81/455, 433

[56] References Cited

U.S. PATENT DOCUMENTS

| | | | |
|---|---|---|---|
| 4,404,877 | 9/1983 | Mizuno et al. | 81/435 |
| 5,109,738 | 5/1992 | Farian et al. | 81/434 |
| 5,239,900 | 8/1993 | Macris | 81/433 |
| 5,337,636 | 8/1994 | Shea | 81/435 |
| 5,408,903 | 4/1995 | Ramin | 81/433 |
| 5,570,618 | 11/1996 | Habermehl et al. | 81/434 |
| 5,687,624 | 11/1997 | Tsuge et al. | 81/434 |
| 5,870,933 | 2/1999 | Habermehl et al. | 81/434 |
| 5,927,163 | 7/1999 | Habermehl | 81/434 |
| 5,943,926 | 8/1999 | Habermehl | 81/434 |

*Primary Examiner*—David A. Scherbel
*Assistant Examiner*—Lee Wilson
*Attorney, Agent, or Firm*—Dorsey & Whitney LLP

[57] ABSTRACT

A screwdriver with a nose having a touchdown foot to engage a workpiece and an arm member forward of the foot forming a slotway between the foot and the arm member adapted to receive edges of sheet material and hold the sheet material against movement away from a screw being driven.

19 Claims, 5 Drawing Sheets

SCREWDRIVER FOR JOINING METAL FRAMING

SCOPE OF THE INVENTION

This invention relates to drivers for joining sheet metal together with fasteners and more particularly to a screwdriver with a hook arm for joining metal framing together.

BACKGROUND OF THE INVENTION

In joining two sheets of metal together with fasteners such as self drilling threaded fasteners, difficulties arise in that on the fastener passing through a first sheet and engaging an unsupported second sheet, that the unsupported second sheet may deflect away on engagement with the screw. Such difficulties particularly arise when joining together metal framing comprising U-shaped channel members of sheet metal where overlapping portions of the U-shaped channel members are desired to be joined together with screws.

SUMMARY OF THE INVENTION

To at least partially overcome these disadvantages, the present invention provides a driver for fasteners, preferably threaded fasteners with a mechanism to support the sheet metal against movement away from the fastener being driven.

An object of the present invention is to provide a driver for fasteners to hold one or more sheets of material against movement axially way from a fastener to be driven into the sheets.

Another object is to provide a power screwdriver to drive screws through sheet metal.

Another object is to provide a power screwdriver to receive and drive screws, which are collated together in a holding strap, through one or more sheets of metal.

Another object is to provide a method of driving fasteners through sheet material, preferably, metal framing members in which the sheet material is unsupported.

Another object is to provide a nose assembly for a screwdriver adapted to join metal-framing members preferably which assembly is removable from the screwdriver.

Accordingly, in one aspect, the present invention provides a screwdriver mechanism for driving screw into a workpiece having:

- a drive shaft rotatable about an axis, the drive shaft having a bit at one end for engaging and driving a screw,
- a screw guide to receive a screw therein coaxially aligned with the drive shaft,
- the drive shaft reciprocally axially slidable relative the screw guide to engage a screw in the screw guide and advance the screw forwardly into a workpiece,
- the screw guide having a nose assembly comprising:
  - a forwardly directed touch down foot to engage a workpiece;
  - an arm member located forwardly relative the foot, the arm member having a first connected end, a second free end, and a rearwardly directed arm surface;
  - a bridge portion joining the first end of the arm member to the nose assembly at a location spaced radially from the axis;
  - the arm member extending generally normal the axis from the bridge portion to the free end; and
  - a slotway extending generally normal the axis forward of the foot between the foot and the arm member from the free end of the arm member to the bridge portion.

In another aspect, the present invention provides an apparatus for automatically driving threaded fasteners, such as screws or the like, which are joined together in spaced parallel relation by a strap comprising:

- a housing,
- a power driver secured to the housing,
- a drive shaft operatively connected to the power driver for rotation about a longitudinal axis,
- a slide body coupled to the housing for reciprocal displacement parallel to the axis of the drive shaft between an extended position and a retracted position,
- the slide body including a screw guide to receive a screw therein coaxially aligned with the drive shaft,
- a screw feed mechanism to receive the fasteners and strap and advance successive threaded fasteners into the screw guide for engagement by the drive shaft on reciprocal displacement of the slide body relative the housing,
- the drive shaft reciprocally axially slidable relative the screw guide to engage a screw in the screw guide and advance the screw forwardly into a workpiece,
- the slide body having a nose assembly comprising:
  - a forwardly directed touch down foot to engage a workpiece;
  - an arm member located forwardly relative the foot, the arm member having a first connected end, a second free end, and a rearwardly directed arm surface;
  - a bridge portion joining the first end of the arm member to the nose assembly at a location spaced radially from the axis;
  - the arm member extending generally normal the axis from the bridge portion to the free end; and
  - a slotway extending generally normal the axis forward of the foot between the foot and the arm member from the free end of the arm member to the bridge portion.

The present invention further provides a screwdriver with a nose having a touchdown foot to engage a workpiece and an arm member forward of the foot forming a slotway between the foot and the arm member adapted to receive edges of sheet material and hold the sheet material against movement away from a screw being driven.

The present invention provides in combination with a driver for fasteners and mechanism to hold one or more sheets of material while the fastener is applied from one side. The invention is particularly applicable to power drivers for threaded fasteners such as screws however is not limited to such drivers. The present invention is also applicable to other drivers such as power drivers for nails, staples, tacks and rivets and the like. The invention provides for drivers of fasteners, a rearwardly directed sufficient surface forward of a fastener being driven to assist preventing sheet material through which the fastener is to be driven from deflecting away from the fastener. In a preferred form the mechanism provides an arm member fixed to a driver forward of a touch down foot for the fasteners driver with a slotway between the touch down feet and the arm member to receive sheet material, the arm member prevents the sheet material from moving unduly away from a fastener being driven. Preferably the arm member is part of a fixed position hook secured to the driver with the slotway open to one side to facilitate the hook member being easily manipulated by driver to receive an edge portion of the sheet material within the slotway.

DETAILED DESCRIPTION OF THE DRAWINGS

Further aspects and advantages will become apparent from the following description of preferred embodiments of the invention taken together with the accompanying drawings in which.

DETAILED DESCRIPTION OF THE PREFERRED EMBODIMENT

Figure 1:
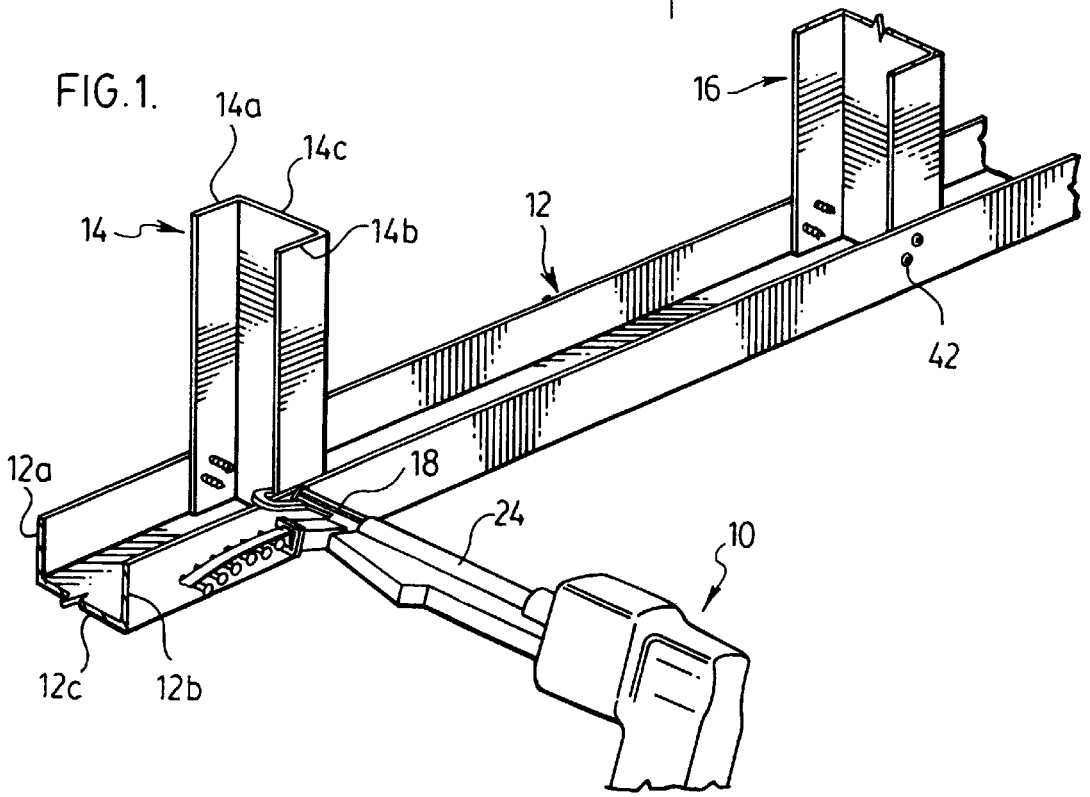
FIG. 1 is a schematic front perspective view showing a power screwdriver mechanism in accordance with a first embodiment of the invention in use in joining metal framing members together.

Reference is made to FIG. 1 which illustrates a power screwdriver 10 in accordance with the present invention as used to join metal framing together.

The metal framing is shown as three separate frame members 12, 14 and 16 each comprising an elongate U-shaped channel member formed of sheet metal. As is well known, each frame member has two side flanges indicated by the letters "a" and "b" and a center indicated by the letters "c". The members shown are part of a frame as for a wall utilizing member 12 as a horizontal floor runner and vertical members 14 and 16 as vertical studs. For example, in conventional construction, another horizontal member would be provided at the top of the vertical members 14 and 16. The vertical members 14 and 16 would be representative of but a number of such frame members repeated at constant distance, for example, on about 16 inch centers over a length of rectangular frame to form a wall.

Each member 12, 14 and 16 is shown with two side flanges and a center. The vertical frame members 14 and 16 are shown to have their longitudinal ends received within the channel formed by member 12, that is, for example, with the side flanges 14*a* and 14*b* of frame member 14 inside the side flanges 12*a* and 12*b* of the frame member 12. Screws 42 are provided to secure, for example, the overlapping side flanges 12*a* and 14*a* together and to secure the overlapping side flanges 12*b* and 14*b* together.

Figure 2:
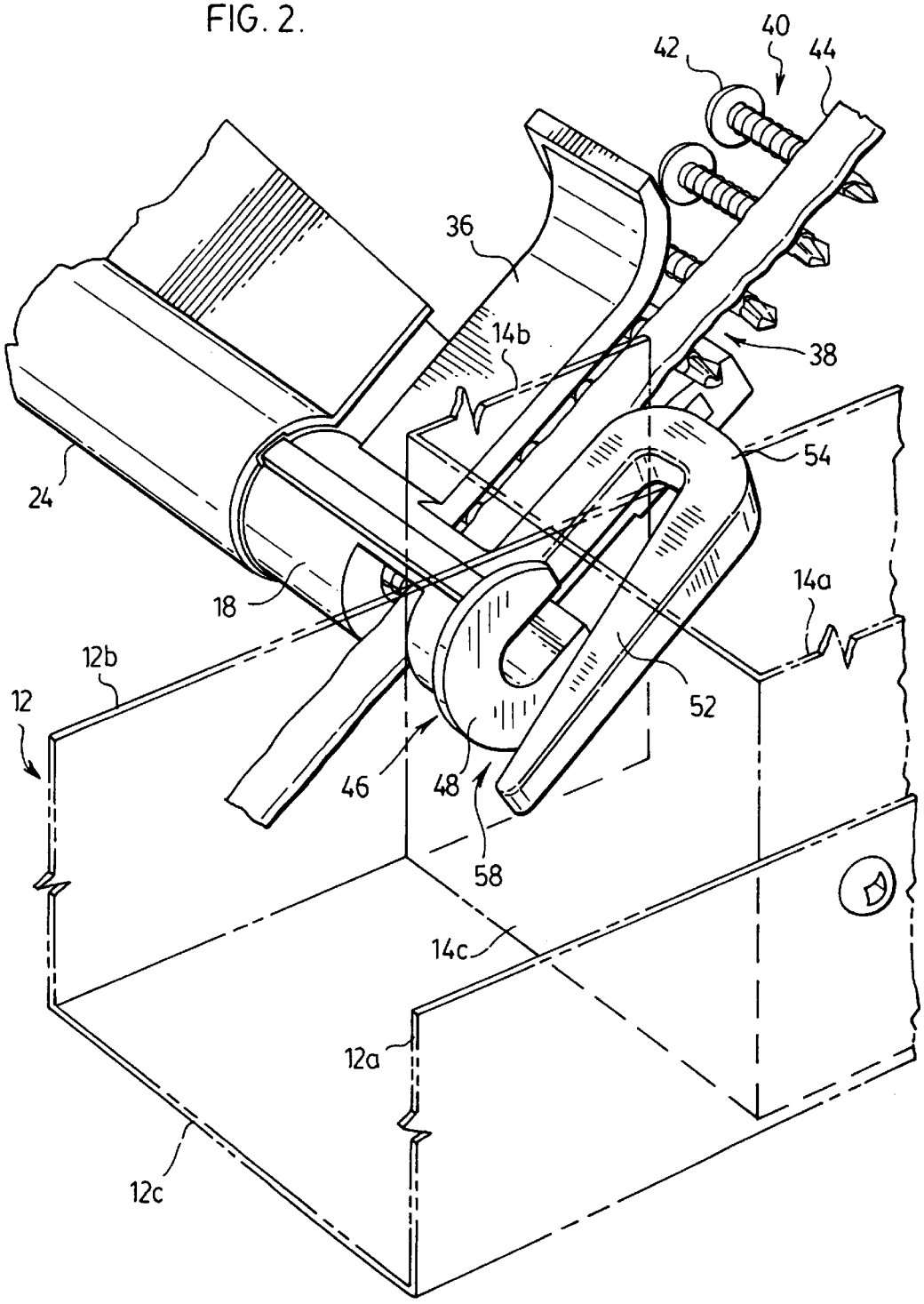
FIG. 2 is an enlarged schematic rear perspective view of a portion of FIG. 1 showing portions of the screw driver mechanism in solid lines and the metal framing in phantom lines and in a relative position before a screw is driven.

Reference is made to FIG. 2 which shows an enlarged view of the front end of the power driver 10 and metal frames 12 and 14 as seen in FIG. 1. The power driver is of a known type and construction similar to that taught by U.S. Pat. No. 5,568,753 issued Oct. 29, 1996 and U.S. Pat. No. 5,570,618 issued Nov. 5, 1996 which are incorporated herein by reference and are adapted to drive collated screws of the type taught, for example, by U.S. Pat. No. 4,167,229 issued Sep. 11, 1979.

The power driver 10 has a housing 24 within which a rotatable driver shaft 26 is carried rotatable about its longitudinal axis 28 and with a bit 30 at its forward end to engage a screw to be driven. A slide body 18 is adapted to be telescopically slidable relative the housing 24 and shaft 26 parallel the axis 28 and preferably biased to an extended position by a spring not shown.

The slide body 18 in effect comprises a screw guide to receive successive screws aligned with the axis 28 for driving by the driver shaft 26 on retraction of a slide body 18 into the housing 24. In this regard, the slide body 18 has a generally cylindrical guideway 34 therethrough coaxially about the axis and through which the driver shaft 26 may extend. A screw feed channel 36 extends radially to one side providing a channelway 38 within which screws are advanced radially into the guideway 34. The screws are in a screwstrip 40 comprising a plurality of screws 42 secured in spaced parallel relation held in a plastic holding strap 44. Each screw 42 is shown as being a self tapping and drilling screws which will, on engaging sheet metal and being rotated, bore an opening through the sheet metal and forms threads therein. A feed mechanism not shown but preferably of the type taught by U.S. Pat. No. 5,570,618 advances one successive screw 42 on the strap 44 with each cycle of reciprocal in and out sliding of the slide body 18 relative the housing 24. The strap 44 from which screws have been driven exits from the guideway 34 on the side opposite that from which the screws are fed.

In each cycle, at an initial position in which the slide body 18 is fully extended from the housing 24 as biased outwardly, the driver shaft 26 is rearward of the head of the screw 42 to be driven which screw 42 is coaxially disposed within the guideway 34.

As is known, the slide body 18 has a nose assembly including a touchdown foot 46 about the guideway 34 with a forwardly directed foot surface 48 to engage a workpiece. In accordance with the present invention, the nose assembly is provided with a sheet engaging hook member generally indicated 50. The hook member 50 is generally U-shaped having an arm member 52 connected by a bridge portion 54 to a radial extension 56 of the foot 46. A slotway 58 is formed between the foot 46 and the arm member 52 with the slotway 58 extending radially relative the axis 28 from a free end 60 of the arm member 52 to a second end 62 of the arm member where the arm member is connected by the bridge portion 54 to the foot 46. More particularly, the arm member 52 has a rearwardly directed arm surface 64 and the slotway 58 is defined between the arm surface 64 and a forwardly directed foot surface 48 on the foot 46.

Figure 3:
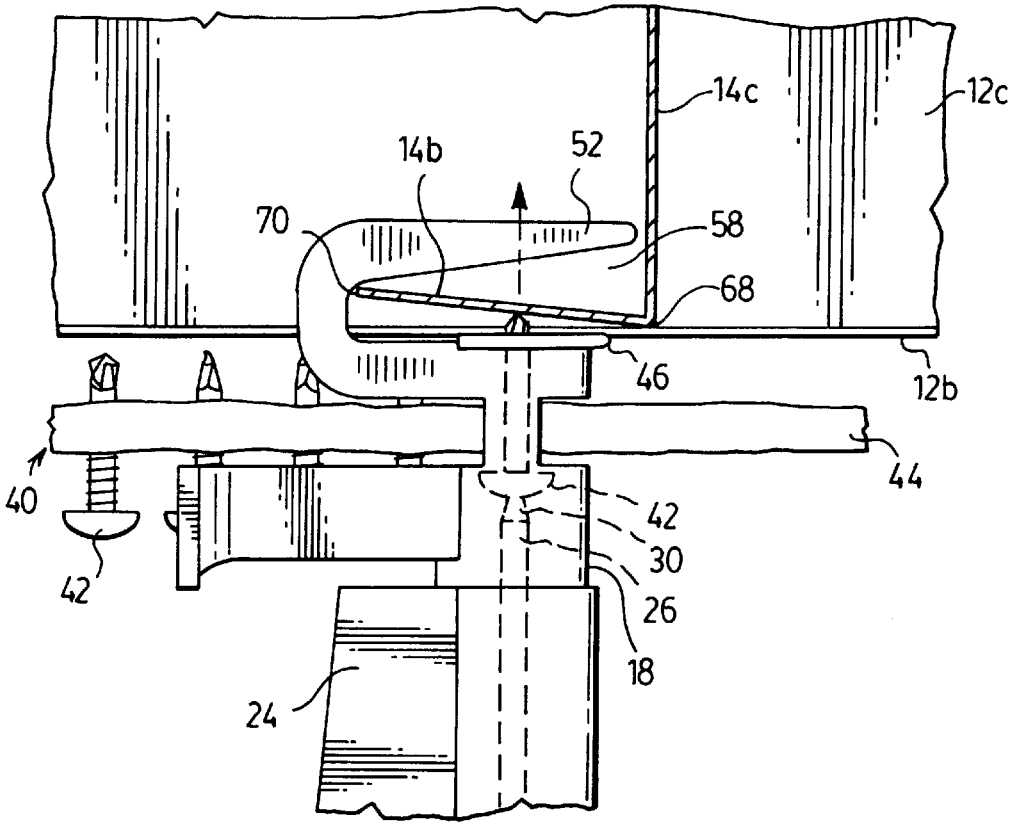
FIG. 3 is a top view of portions of FIG. 1 showing the driver assembly and with the screw being driven shown after it has passed through a first sheet of metal but before it passes through a second sheet of metal.
Figure 4:
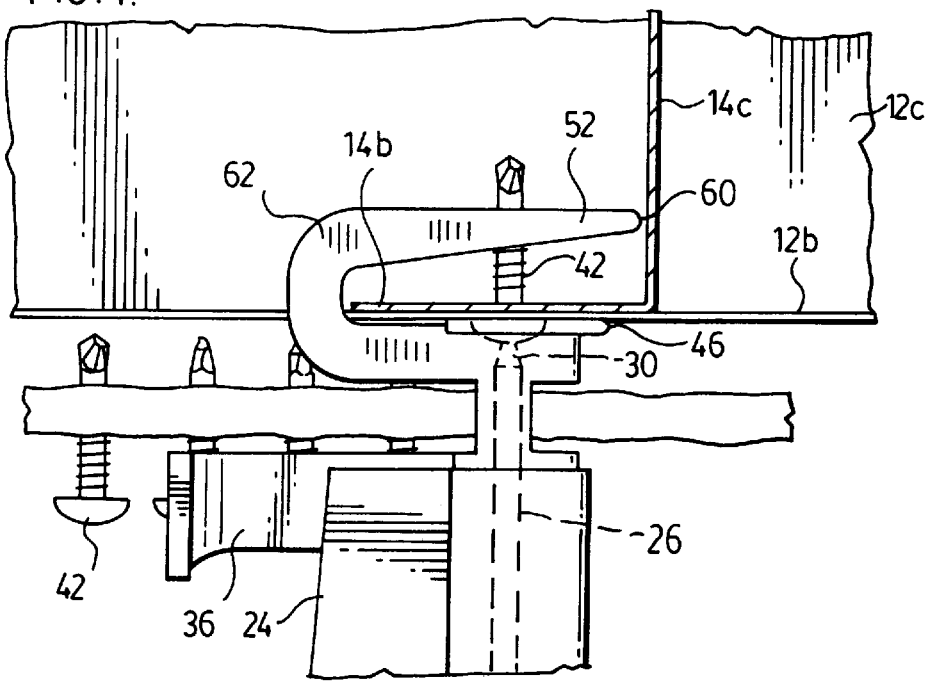
FIG. 4 is a top view the same as FIG. 3 however showing the screw as fully driven.
Figure 5:
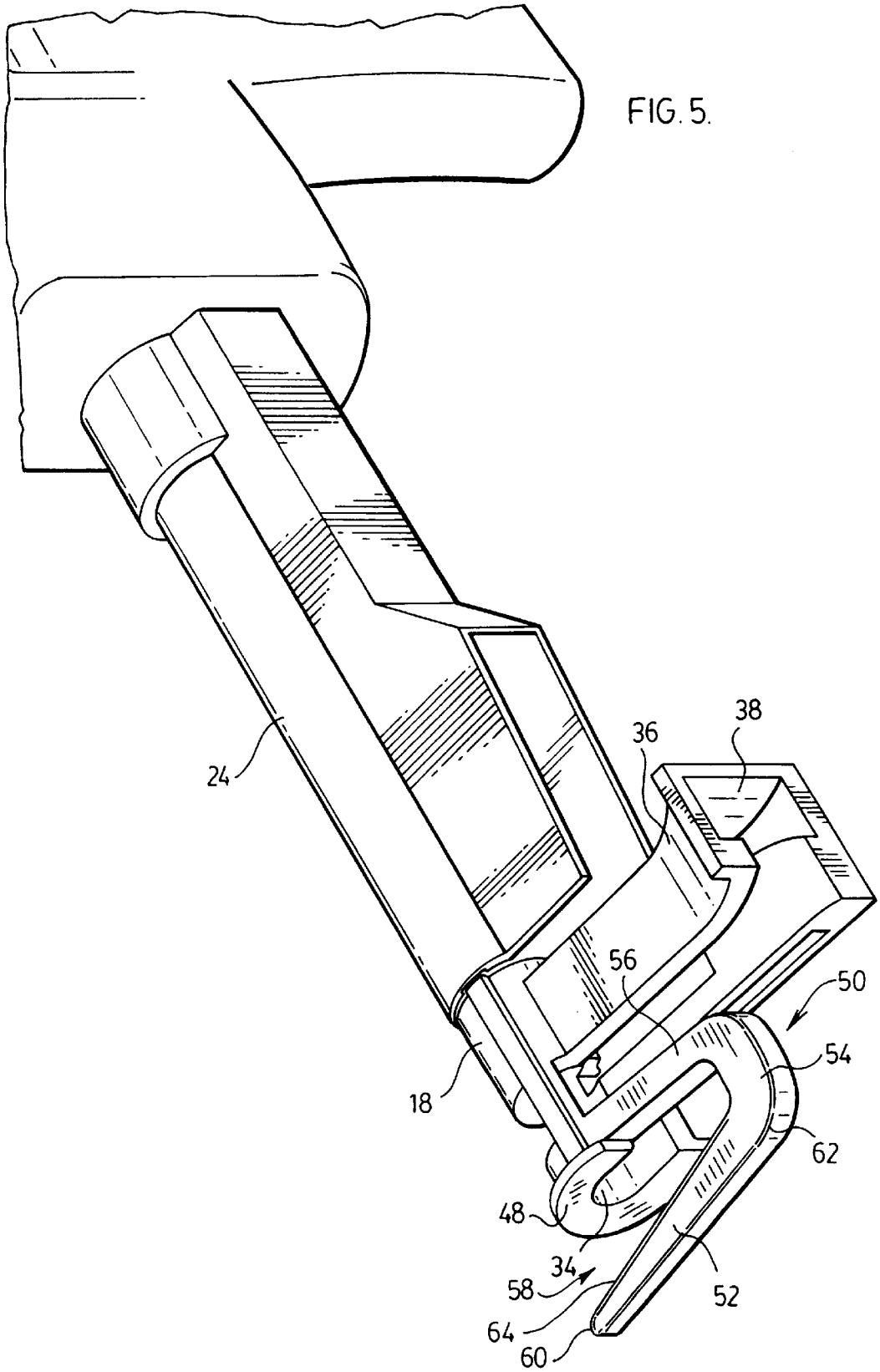
FIG. 5 is a pictorial view of the power driver of FIG. 1.

As seen in FIGS. 2 to 4, the driver tool 10 is positioned with the side flanges 12*a* and 14*a* disposed in the slotway 58 between the foot 46 and the arm member 52. FIG. 2 shows the relative position of a screw 42 to be driven with the slide body 18 fully extended. Subsequently on a user urging the power driver 10 and its housing 24 forwardly with the foot surface 48 of the foot 46 urged into the outside surface of flange 12*a* of the frame 12, the slide body 18 is forced to retract into the housing 24 with the rotating driver shaft 26 to engage the head of the screw 42 and urge it into the outside surface of the flange 12*a*. With the application of force and with rotation, the screw 42 comes to pass through the flange 12*a*.

FIG. 3 shows the condition which arises when the screw 42 passes through the flange 12*a* and into engagement with the flange 14*a*. As the flange 14*a* is unsupported, it is urged forwardly by the screw 42 bending at its supported edge 68. As shown, deflection of the flange 14*a* is stopped upon the free end 70 of the flange 14*a* engaging the arm surface 64 of the arm member 52. With the flange 14*a* engaged on the arm member 52, the screw 42 being driven is able to apply axially directed forces sufficient to permit tapping and drilling through the flange 14*a* so as to pass through the flange 14*a*. Preferably, the hook member 50 is configured so that the flange 14*a* engages the arm member 52 with the flange 14*a* disposed at an angle normal the axis of less than about 20 degrees.

With subsequent rotation of the screw 42, the screw draws the flange 14*a* rearwardly back into the flange 12*a*, drawing the two flanges together as seen in FIG. 4 at the end of a cycle of reciprocal movement of the slide body 18 and, preferably in approximately which position the bit comes to disengage the screw 42 to, on one hand, fully seat the screw and, on the other hand, to discontinue rotation of the screw so as not to strip the threads formed in the flanges 12*a* and 14*a*.

Figure 7:
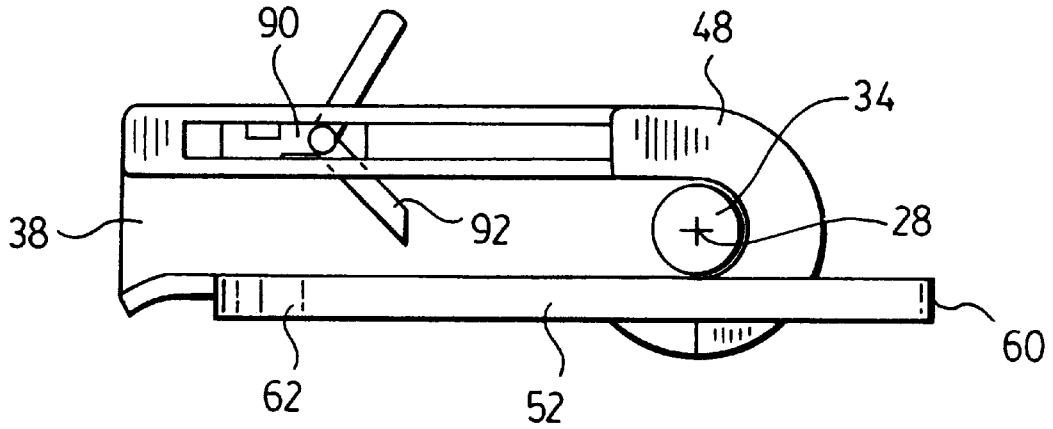
FIG. 7 is an end view of the guide tube assembly as seen in FIG. 6.

As best seen in FIG. 7, the arm member 52 is disposed radially to one side of the axis 28. Preferably, the arm member is disposed radially relative the axis 28 to one radial side of the cylindrical guideway 34. It is to be appreciated that the arm member 52 should be provided so as to not impede passage of a screw being driven axially forward past the arm member 52. At a minimum, the arm should be radially to one side of the axis 28 a distance at least greater than a diameter of a shaft of the screw to be driven. FIG. 7 illustrates the guideway as being generally cylindrical for axial passage of the screws.

The arm member 52 is spaced forwardly from the foot 46 a distance sufficient to permit sheet of material through which the screws are to be driven to be received in the slotway 58. The actual thickness of the slotway and its radial extent are to be selected having regard, in one hand, to receive sheet material therebetween, and, on the other hand, to keep the sheet material adjacent the arm member 52 in a position that a screw being driven can engage and drive through the sheet engaging the arm member 52. In this regard, preferably the forwardly directed foot surface 48 is disposed normal to the axis 28 and the rearwardly directed arm surface 64 is disposed to be closer to the foot surface 48 as measured parallel axis 28 with increasing distance from the free end 60 of the arm member 52. With the arm member 52 extending at an angle from its free end 60 towards its second end 62, the slot way is of reduced depth measured parallel axis 28 near the bridging portion 54.

While the thickness of the slotway at the free end 60 of the arm member 52 may be selected to be relatively small, it is to be selected having regard to the nature of the sheet material to be received therein. A preferred depth of the slotway at the free end 60 of the arm member 52 is one which in use relatively easily permits a person to position the nose assembly with the sheet material within the slotway.

In the context of securing metal frame member such as illustrated in FIG. 2 which are typically of the thickness of less than 1/16", preferred depth of the slot way at the axis 28 is not greater than about ½" and preferably not greater than about ⅜".

Figure 6:
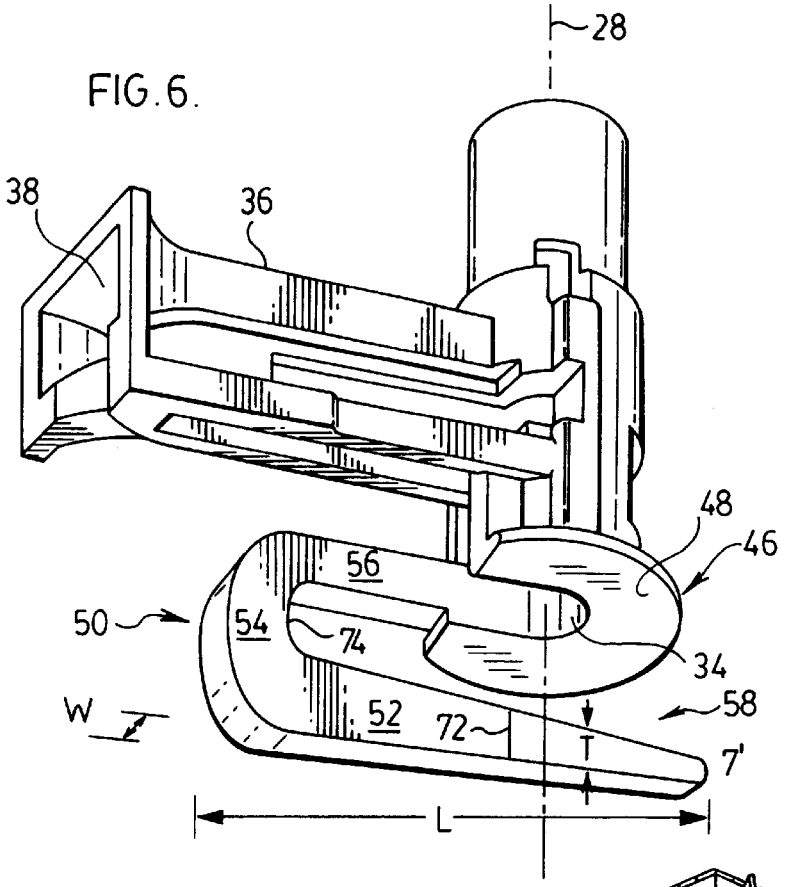
FIG. 6 is a pictorial view of a guide tube assembly removed from the power shown in FIG. 5.

In joining the frame member such as 12 and 14 as shown in FIG. 2, it is necessary to place the power driver such that screws are in effect placed within a closed comer formed by the end of the member 14 being received within the channel of member 12. This is facilitated by having the arm member 52 of a configuration as shown in FIG. 6 in which it is a relatively elongate finger-like member extending longitudinally from the free end 60 to the connected second end 62 with the arm member 52 having a width "W" normal its length "L" which width "W" is small relative its length. Similarly, the thickness "T" measured parallel the axis 28 is preferably small relative its length "L".

The preferred nose assembly shown for example in FIG. 6 incorporates the screw feed channel 36 which extends radially to one side. As shown, the bridge portion 54 is disposed on the same side of the guideway 34 as the screw feed channel 36 with the arm 52 extending generally radially axially in line with the screw feed channel 36 spaced forwardly thereof. This arrangement assists the nose assembly to be inserted into relatively tight spaces.

The preferred embodiment shown in FIG. 6 indicates as a line 72 where the arm member 52 is located closest to the axis 28. As shown, the slotway extends radially a greater extend from said closest location 72 to the connected end 62 of the arm member 52 than from the closest location 72 to the free end 60 of the arm member 52. Thus, as shown in the preferred embodiment, the free end 60 of the arm member 52 is disposed closer to the axis than the connected end 62 of the arm member 52. The free end 60 of the arm member 52 is shown to extend radially outwardly a greater extent than the nose assembly, this is not necessary.

The foot 46 is preferably provided with the foot surface 48 as a ring segment extending radially outwardly from the guideway 34 at least in part circumferentially thereabout. As seen in FIG. 7, the arm member 52 is preferably located directly forwardly of this ring segment formed by the foot surface 48.

Conventional metal frames such as frame member 12 shown in the drawings have their flanges 12*a* and 12*b* of a width in the range of about 1½" to 2" and their centers of a width in the range of about 3¼" to 4". The length of the arm member 52 and the slotway 58 may appropriately be sized, for example, with the arm member to have a length from its free end 60 to the inside surface of 74 of the bridge portion 54 as in the range of about 2" to 4", preferably approximately 2" to 3".

The free end 60 of the arm member 52 in the preferred embodiment extends about ¾" radially past the axis 28. This distance is selected to be an advantageous distance wherein with the arm member 52 disposed at an angle such as shown in FIG. 1, the free end 60 of the arm member 52 may abut the middle 14*c* of the frame member 14 to assist in driving the screw 24 into a desired location.

The preferred embodiment shows the arm member 52 as being an elongate member of relatively small width compared to its length. For use in joining other types of sheet materials which may be frangible, the arm member 52 may need to be provided to have an enlarged surface area for its rearwardly directed arm surface 64. It is to be appreciated that the arm member 52 could provide a relatively substantial rearwardly directed arm surface 64, for example, to extend radially in all directions beyond the extent of the foot and, for example, to have an axial bore therethrough axially in line with the axis 28 and the guideway 34 so as to permit a screw to be driven therethrough without being impeded by the arm member.

The preferred embodiment of the present application has been illustrated utilizing as threaded fasteners, a pan headed screw. It is to be appreciated that other threaded fasteners could be used in accordance with the present invention including threaded fasteners with polygonally shaped heads as to be driven by a socket driver carried at the end of the driver shaft.

The invention of the present application has been described specifically for use with a screwdriver of the type illustrated in U.S. Pat. No. 5,568,753. It is to be appreciated that other screwdrivers for use in driving screws collated in the strip such as those taught by U.S. Pat. No. 5,473,965 to Chen and U.S. Pat. No. 3,930,297 to Potucek could readily be adapted for use with a arm carrying nose as described with the preferred embodiment. In addition, a device of the present invention having a suitable slotway and arm member could be provided in the nose of a screwdriver which is adapted for driving separate screws as located in the guideway individually and manually without any automatic method of feeding the same.

FIG. 6 illustrates a preferred nose assembly in accordance with the present invention. This nose assembly may preferably be formed as being cast as a unitary element for metal or being formed, as by being injection molded out of a strong nylon or plastic material. It is to be appreciated the nose assembly is adapted to be replaceable by other nose assemblies as taught by U.S. Pat. No. 5,568,753 which may or may not have the slotway and arm members as particularly illustrated in this invention. Different nose assemblies in accordance with the present invention may be provided so as to permit the use of screws of different length or to permit the joining the sheet metal materials of different thicknesses and, for example, possibly to secure the edge of a sheet of relatively thick material to the edge of an underlying sheet of thinner material.

FIG. 7 is the only drawing which shows a radially slidable shuttle 90 carrying a pawl 92 to engage a screwstrip 40 and advance it in the channelway 38 as in a manner taught by U.S. Pat. No. 5,570,618.

The construction of the hook member 30 as fixed to the nose piece of the power screwdriver shown in the drawings is directly adapted for use with power motors such as taught by U.S. Pat. No. 4,566,619 to Kleinholz issued Jan. 28, 1986.

Many modifications and variations of the present invention will now occurred to persons skilled in the art. For a definition of the invention reference is made to the appended claims.

What is claimed is:

1. A screwdriver mechanism for driving a screw into a workpiece having:

a drive shaft rotatable about an axis, the drive shaft having a bit at one end for engaging and driving a screw, a screw guide to receive a screw therein coaxially aligned with the drive shaft, the drive shaft reciprocally axially slidable relative the screw guide to engage a screw in the screw guide and advance the screw forwardly into a workpiece, the screw guide having a nose assembly comprising:

a forwardly directed touch down foot to engage a workpiece;

an arm member located forwardly relative the foot, the arm member having a first connected end, a second free end, and a rearwardly directed arm surface;

a bridge portion joining the first end of the arm member to the nose assembly at a location spaced radially from the axis;

the arm member extending generally normal the axis from the bridge portion to the free end; and a slotway extending generally normal the axis forward of the foot between the foot and the arm member from the free end of the arm member to the bridge portion, wherein the arm member is spaced from the foot sufficiently to permit at least two sheets of material desired to be secured together by screws to be received therebetween within the slotway.

2. A mechanism as claimed in claim 1 wherein the arm member is spaced from the foot not greater than about three-quarter of an inch.

3. A mechanism as claimed in claim 1 wherein the arm member is spaced from the foot not greater than about one-half inch.

4. A mechanism as claimed in claim 1 wherein the foot has a forwardly directed foot surface disposed normal to the axis.

5. A mechanism as claimed in claim 4 wherein the foot surface extends from proximate the axis to proximate the bridge member.

6. A mechanism as claimed in claim 4 wherein the rearwardly directed arm surface is disposed closer to the foot surface with increasing distance from the second free end.

7. A mechanism as claimed in claim 4 wherein the arm member does not impede passage of a screw being driven axially forwardly pass the arm surface.

8. A mechanism as claimed in claim 1 wherein the arm member is disposed radially to one side of the axis.

9. A mechanism as claimed in claim 1 wherein the arm member is disposed radially to one side of the axis a distance at least greater than a diameter of a shank of a screw adapted to be driven by the mechanism.

10. A mechanism as claimed in claim 1 wherein the arm member comprises an elongate member extending longitudinally from the first end to the second end, the arm member having a thickness measured normal a direction in which the elongate member extends longitudinally and normal the axis which is small relative a length of the arm measured longitudinally.

11. A mechanism as claimed in claim 10 wherein the screw guide defines a cylindrical guideway therein for axial passage of the screw.

12. A mechanism as claimed in claim 11 wherein the foot surface includes a ring segment thereof extending radially outwardly from the guideway at least partially circumferentially thereabout, the arm member passing axially under the ring segment displaced radially relative the axis to one side of the guideway.

13. A mechanism as claimed in claim 1 wherein the screw guide includes a feed screw channel extending radially to one side of the screw guide to receive screws for advancement in the screw feed channel radially relative the axis into the guideway, the bridge section disposed on the same side of the screw guide as the screw feed channel with the arm member extending generally radially axially in line with the screw feed channel but spaced forwardly thereof.

14. A mechanism as claimed in claim 1 wherein the screw guide includes a feed extends on the side opposite the one side substantially the same radial extent as the foot.

15. A mechanism as claimed in claim 1 wherein the arm member has a closest location thereon where the arm member is closest to the axis, the slotway extends radially a greater extent from said closest location to the first connected end of the arm member then from said closest location to the second free end of the arm member.

16. A mechanism as claimed in claim 1 wherein the second free end of the arm member is disposed closer to the axis than the first connected end of the arm member.

17. A mechanism as claimed in claim 1 wherein the nose assembly including the foot, the arm member and the bridge member comprise an integral element.

18. An apparatus for automatically driving threaded fasteners, such as screws or the like, which are joined together in spaced parallel relation by a strap comprising:

a housing, a power driver secured to the housing, a drive shaft operatively connected to the power driver for rotation about a longitudinal axis, a slide body coupled to the housing for reciprocal displacement parallel to the axis of the drive shaft between an extended position and a retracted position, the slide body including a screw guide to receive a screw therein coaxially aligned with the drive shaft, a screw feed mechanism to receive the fasteners and strap and advance successive threaded fasteners into the screw guide for engagement by the drive shaft on reciprocal displacement of the slide body relative the housing, the drive shaft reciprocally axially slidable relative the screw guide to engage a screw in the screw guide and advance the screw forwardly into a workpiece, the slide body having a nose assembly comprising:

a forwardly directed touch down foot to engage a workpiece;

an arm member located forwardly relative the foot, the arm member having a first connected end, a second free end, and a rearwardly directed arm surface;

a bridge portion joining the first end of the arm member to the nose assembly at a location spaced radially from the axis;

the arm member extending generally normal the axis from the bridge portion to the free end; and a slotway extending generally normal the axis forward of the foot between the foot and the arm member from the free end of the arm member to the bridge portion, wherein the arm member is spaced from the foot sufficiently to permit at least two sheets of material desired to be secured together by screws to be received therebetween within the slotway.

19. A mechanism as claimed in claim 18 wherein the screw feed mechanism includes a feed screw channel extending radially to one side of the screw guide to receive screws for advancement in the screw feed channel radially relative the axis into the screw guide, the bridge section disposed on the same side of the screw guide as the screw feed channel with the arm member extending generally radially axially in line with the screw feed channel but spaced forwardly thereof.

* * * * *